US007970307B2

(12) United States Patent
Mabuchi et al.

(10) Patent No.: US 7,970,307 B2
(45) Date of Patent: Jun. 28, 2011

(54) METHODS AND APPARATUS FOR TRANSFERRING A TONER IMAGE VIA ELECTROPHOTOGRAPHICS

(75) Inventors: Hiroyuki Mabuchi, Ibaraki (JP); Akitomo Kuwabara, Ibaraki (JP)

(73) Assignee: Ricoh Company, Ltd., Tokyo (JP)

( * ) Notice: Subject to any disclaimer, the term of this patent is extended or adjusted under 35 U.S.C. 154(b) by 379 days.

(21) Appl. No.: 12/122,938

(22) Filed: May 19, 2008

(65) Prior Publication Data

US 2009/0010667 A1 Jan. 8, 2009

(30) Foreign Application Priority Data

Jul. 5, 2007 (JP) ..... 2007-177513

(51) Int. Cl.
*G03G 15/16* (2006.01)

(52) U.S. Cl. ..... 399/66

(58) Field of Classification Search ..... 399/66, 399/121, 297–299, 302
See application file for complete search history.

(56) References Cited

U.S. PATENT DOCUMENTS

| | | | | |
|---|---|---|---|---|
| 3,751,156 A | | 8/1973 | Szostak et al. | |
| 3,866,573 A | | 2/1975 | Szostak et al. | |
| 4,110,031 A | * | 8/1978 | Ebi et al. | 399/66 |
| 4,220,699 A | * | 9/1980 | Ishida et al. | 430/125.3 |
| 4,268,157 A | | 5/1981 | Ebi et al. | |
| 5,515,146 A | * | 5/1996 | Harasawa et al. | 399/310 |
| 5,926,669 A | * | 7/1999 | Sugimoto et al. | 399/66 |

FOREIGN PATENT DOCUMENTS

| | | | |
|---|---|---|---|
| JP | 49-18335 | | 2/1974 |
| JP | 51-151544 | | 12/1976 |
| JP | 57-10427 | | 2/1982 |
| JP | 62-3423 | | 1/1987 |
| JP | 07-064411 | | 3/1995 |
| JP | 08054789 A | * | 2/1996 |

OTHER PUBLICATIONS

Machine English translation of JP08-054789.*

* cited by examiner

*Primary Examiner* — David M Gray
*Assistant Examiner* — Billy J Lactaoen
(74) *Attorney, Agent, or Firm* — Ladas & Parry LLP

(57) ABSTRACT

A transfer apparatus capable of suitably measuring the amount of electric charges transferred from a transfer member to a transfer body and performing a transfer process without degrading the image quality by supplying an amount of electric charges suitable for any type of transfer body onto which an toner image is to be transferred. The transfer apparatus in an image forming apparatus employing an electrophotographic method includes the transfer member electrically charging the transfer body; a charging unit for electrically charging a surface of the transfer member; and voltage sensors for measuring the voltage at each of an upstream area and a downstream area on the transfer member with respect to a transfer nip section of the transfer member.

7 Claims, 8 Drawing Sheets

PRINTING STATE

PRINT STAND-BY STATE

METHODS AND APPARATUS FOR TRANSFERRING A TONER IMAGE VIA ELECTROPHOTOGRAPHICS

BACKGROUND OF THE INVENTION

1. Field of the Invention

The present invention generally relates to a transfer apparatus, a transfer method, and an image forming apparatus.

2. Description of the Related Art

In an electrostatic recording apparatus such as a printer and a copier employing an electrophotographic method, an image carrier called a photosensitive body is charged uniformly at a prescribed voltage; an electrostatic latent image is formed by exposing the surface of the uniformly charged image carrier based on image information; an image visualizing agent called toner is used to form a visible image (called a toner image); and the formed visible image is transferred and fixed onto a recording medium such as a recording paper to form the image on the recording medium. In a full-color printing apparatus, a process of superposing plural toner images is required. To that end, first, the plural toner images are transferred onto an intermediate transfer medium, and the superposed toner image formed on the intermediate transfer medium is transferred and fixed onto a recording medium.

A continuous-paper printer employing the electrophotographic method has become more and more popular in printing various applications such as direct mail, invoices, and books. As such applications expand, cases where a paper having an uneven surface such as a rough-surfaced paper is used are also increasing. In such cases, unfortunately, defective images are likely to be printed onto such a paper due to poor contact between the photosensitive body and the paper.

Further, in double-sided printing in a continuous-paper printer, a tandem method using two printers is generally used where a paper printed by a first printer is reversed so that the other side of the paper is printed by a second printer. In this case, as well, defective images are likely to be printed when images are transferred onto the paper in the second printer due to unevenness of the surface of the paper caused by the shrinkage of the paper that is heated in a fixing process in the first printer.

As a transfer method capable of providing sufficient contact between the paper and the photosensitive body, a roller transfer method and a belt transfer method are generally known. In the roller transfer method and the belt transfer method, a toner image is transferred onto the paper by using an electrostatic force while the paper is pressed against the photosensitive body by a roller or a belt, respectively. There are two known methods of generating the electrostatic force. One method is to apply current or voltage to the core bar of the transfer roller (hereinafter referred to as "core bar applying method"). The other method is to charge a dielectric layer on the surface of the transfer roller (hereinafter referred to as "external charging method").

As an example of the "core bar applying method", Japanese Patent Application Publication No. H07-64411 discloses a transfer bias controlling method for controlling a bias voltage applied to the core bar of the transfer roller. In the method, a voltage is applied to the core bar of the transfer roller so that a bias voltage is formed between the photosensitive body and the transfer roller. To determine an appropriate bias voltage, currents are measured when there is a paper in the transfer nip section and when there is no paper in the transfer nip section. Based on the calculation of the measured data, the bias voltage is controlled. A transfer apparatus employing the "core bar applying method" is generally used in a low-speed or middle-speed printer for cut sheet paper. Unfortunately, it is difficult for a printer employing the "core bar applying method" to provide the necessary stable voltage or current to the rear side of a paper sheet through a roller or a belt for a long continuous period due to changes of circumstance and paper width. Especially, a printer employing the "core bar applying method" is not suited to be used as a continuous-paper printer requiring high throughput and high durability.

On the other hand, in the "external charging method", a dielectric layer is formed on the elastic layer of the transfer roller, and the surface of the dielectric layer is charged by using a corona electrification device or a roller electrification device. Because of this feature, advantageously, it is not necessary to consider the charge transfer from the inside of the transfer roller, and various materials may be used for the dielectric layer as the surface of the transfer roller. Therefore, an organic material having excellent durability can be selected and used, thereby improving the durability of the transfer roller. Further, when a large-scale printer employing the "core bar applying method" and capable of printing a large paper having an image forming width of 500 mm or more prints on a continuous paper having a short image forming width, a larger area where the transfer roller is not in contact with the paper is generated. In this case, there is a problem that a large current directly flows to a contacting surface between the photosensitive body and the transfer roller, thereby preventing the formation of the electric field necessary for the paper to be printed. However, this problem does not occur in a printer employing the "external charging method".

As examples of transfer apparatuses employing the "external charging method", Japanese Patent Publication No. S57-10427 and Japanese Patent Application Publication No. S49-18335 disclose a transfer roller where a corona discharge is used to charge a surface of the transfer roller. Further, Japanese Patent Publication No. S62-3423 discloses a transfer apparatus including a transfer roller having a surface charged by corona discharge, an electrometer measuring the charge amount on the transfer roller, and a discharger for removing electric charges on the surface of the transfer roller so that the charge amount becomes constant and the electric charges on the surface of the transfer roller after charging a recording sheet are removed. Japanese Patent Application Publication No. S51-151544 discloses a transfer apparatus using a transfer belt instead of the above transfer roller and the surface of the transfer belt is charged by corona discharge.

In the "core bar applying method", the amount of electric charges supplied to the transfer nip section can be easily obtained from the current of a power source electrically connected to the core bar of the transfer roller. Therefore, it is possible to respond to environmental changes including the type of recording paper by appropriately adjusting the voltage or current of the power source. On the other hand, in the "external charging method", the amount of electric charges supplied to the dielectric layer on the surface of the transfer roller can be detected or adjusted based on the voltage or current of the power source for, for example, a corona charger for corona charging.

However, in a transfer apparatus employing the "external charging method", the charger electrically charges the dielectric layer of the surface of the transfer roller; the electric charges on the dielectric layer are supplied to the recording paper so as to electrically charge the recording paper when the recording paper is in contact with the transfer roller (transfer nip section); and the toner image is transferred from the photosensitive body onto the recording paper by the voltage difference generated by the supplied electric charges. Because of this feature, it is difficult to directly detect the amount of electric charges supplied from the surface of the transfer roller to the recording paper at the transfer nip section. In addition, the entire charge amount on the surface of the transfer roller is not always supplied to the recording paper. As a result, the charge amount supplied from the surface of the transfer roller to the recording paper at the transfer nip section can not be obtained easily. Because of this difficulty, unfortunately, it is difficult to obtain appropriate transfer conditions responding to environmental changes including a change to a different type of recording paper, thereby degrading the image quality due to, for example, the lowering of transfer efficiency and splashing of toner.

SUMMARY OF THE INVENTION

The present invention is made in light of problems and may provide a transfer apparatus, a transfer method, and an image forming apparatus including the transfer apparatus, capable of appropriately measuring the amount of electric charges supplied from a transfer roller to a transfer body and performing a transferring process without degrading image quality by supplying an appropriate amount of electric charges adapted to transfer a toner image onto any type of transfer body.

To solve the above problems, the present inventors have made the present invention described below.

According to a first aspect of the present invention, there is provided a transfer apparatus for transferring a toner image from a toner image carrier to a transfer body in an image forming apparatus employing an electrophotographic method. The transfer apparatus includes a transfer member electrically charging the transfer body; a charging unit for electrically charging a surface of the transfer member; and voltage sensors for measuring voltage at each of an upstream area and a downstream area on the transfer member with respect to a transfer nip section of the transfer member.

Preferably, the charging unit includes a charge controlling unit controlling the amount of electric charges transferred from the charging unit to the transfer member so that a voltage difference between the upstream area and the downstream area with respect to a transfer nip section of the transfer member is maintained substantially at a prescribed value.

Further preferably, a voltage measurement position at which each of voltage sensors measures a voltage is disposed on a part of a surface of the transfer member, and the part of a surface of the transfer member is in contact with a toner image non-transfer area onto which no toner image is transferred when a toner image is transferred onto the transfer body.

Still further preferably, each of the voltage sensors is a noncontact voltage sensor.

Still further preferably, the transfer body is either a recording medium or an intermediate transfer medium.

Still further preferably, the transfer member is either a transfer roller or a transfer belt.

According to a second aspect of the present invention, there is provided a transfer method of transferring a toner image from a toner image carrier onto a transfer body by a transfer apparatus having a transfer member in an image forming apparatus employing an electrophotographic method. The transfer method includes a step of supplying electric charges to a surface of the transfer member so that a voltage difference between an upstream area and a downstream area with respect to a transfer nip section of the transfer member is maintained substantially at a prescribed value.

Preferably, the voltage difference between an upstream area and a downstream area with respect to a transfer nip section of the transfer member is a voltage difference between parts of a surface of the transfer member, and each of the parts of a surface of the transfer member is in contact with a toner image non-transfer area onto which no toner image is transferred when a toner image is transferred onto the transfer body.

According to a third aspect of the present invention, there is provided an image forming apparatus employing an electrophotographic method and including a photosensitive body, a charging device electrically charging the photosensitive body, an exposing device forming an electrostatic latent image on the charged photosensitive body, a developing device developing the electrostatic latent image into a toner image, a transfer apparatus transferring the toner image onto a recording medium, a feeding device feeding the recording medium, and a fixing device fixing the toner image onto the recording medium on which the toner image is transferred, wherein the transfer apparatus is as described above.

According to an embodiment of the present invention, it is possible to appropriately measure the electric charge amount transferred from a transfer roller to a transfer body and perform a transferring process without degrading image quality by supplying an appropriate charge amount adapted to transfer a toner image onto any type of transfer body.

BRIEF DESCRIPTION OF THE DRAWINGS

Other objects, features, and advantages of the present invention will become more apparent from the following description when read in conjunction with the accompanying drawings, in which.

DETAILED DESCRIPTION OF THE PREFERRED EMBODIMENTS

Exemplary embodiments of the present invention are described below with reference to the accompanying drawings. It should be noted that a so-called person skilled in the art could easily modify any of the embodiments of the present invention to provide another embodiment, and such a modified embodiment is explicitly included in the technical scope of the present invention. That is, the present invention is not limited to the embodiments described below.

First Embodiment

Figure 1:
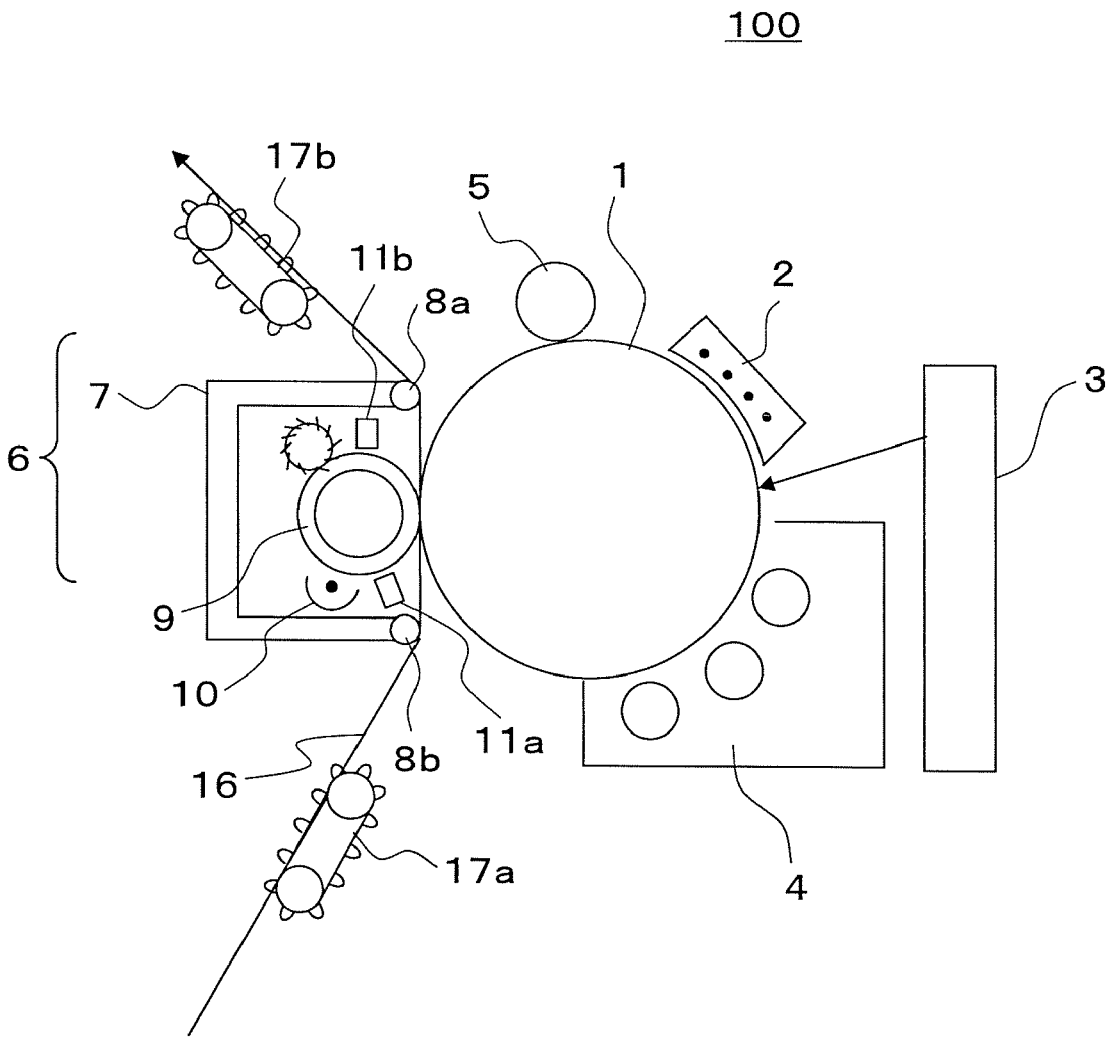
FIG. 1 is a schematic view showing an exemplary configuration of an image forming apparatus including a transfer apparatus according to an embodiment of the present invention.

FIG. 1 is a schematic view showing an image forming apparatus 100 including a transfer apparatus 6 according to a first embodiment of the present invention. As shown in FIG. 1, it is assumed that the image forming apparatus 100 is a continuous imaging (printing) apparatus for high-speed continuous-paper printing including an OPC photosensitive body 1 of negative chargeability as a toner carrier.

Around the outer circumference of the photosensitive body 1 serving as the toner carrier, there are provided a charging device 2, an exposing device 3, a developing device 4, and the transfer apparatus 6 arranged in the rotating direction of the photosensitive body 1. Now, an image forming cycle on the photosensitive body 1 in accordance with the rotation of the photosensitive body 1 is described. First, the surface of the photosensitive body 1 is uniformly charged by the charging device 2. An electrostatic latent image based on printing information is formed on the uniformly negatively charged surface of the photosensitive body 1 by irradiating a laser light beam onto the surface of the photosensitive 1 using a laser scanning optical system of the exposing device 3. Then, a toner image is formed by the developing device 4 adhering toner onto the electrostatic latent image. The transfer apparatus 6 transfers the formed toner image onto a continuous printing paper 16 serving as a transfer body. Residual toner on the surface of the photosensitive body 1 after the toner image is transferred is removed by a cleaning device 5, and the process goes on to the next image forming cycle.

The continuous printing paper 16 serving as a recording medium is fed by tractors 17*a* to a transfer nip section serving as a contacting surface between the photosensitive body 1 and the transfer apparatus 6. In the transfer nip section, a toner image is transferred onto the continuous printing paper 16. Then, the continuous printing paper 16 is fed to a fixing device by tractors 17*b*. The toner image on the continuous printing paper 16 is melted and fixed onto the continuous printing paper 16 by the fixing device to complete the printing.

Next, an exemplary configuration and operation of the transfer apparatus 6 are described. As shown in FIG. 1, the transfer apparatus 6 includes a housing 7, a transfer roller 9, a corotron charger 10 and voltage sensors 11*a* and 11*b*. The housing 7 has an upper paper guide 8*a* and a lower paper guide 8*b*, each guiding the continuous printing paper 16. The housing 7 accommodates the transfer roller 9. The corotron charger 10 supplies electric charges to the surface of the transfer roller 9 and serves as a transfer roller charging unit. The voltage sensors 11*a* and 11*b* detect a voltage of the surface of the transfer roller 9 on the upstream side and on the downstream side, respectively, in the rotating direction (in printing) of the transfer roller 9 with respect to the transfer nip section where the transfer roller 9 is in contact with the photosensitive body 1 with the continuous printing paper 16 sandwiched between the transfer roller 9 and the photosensitive body 1.

Figure 3:
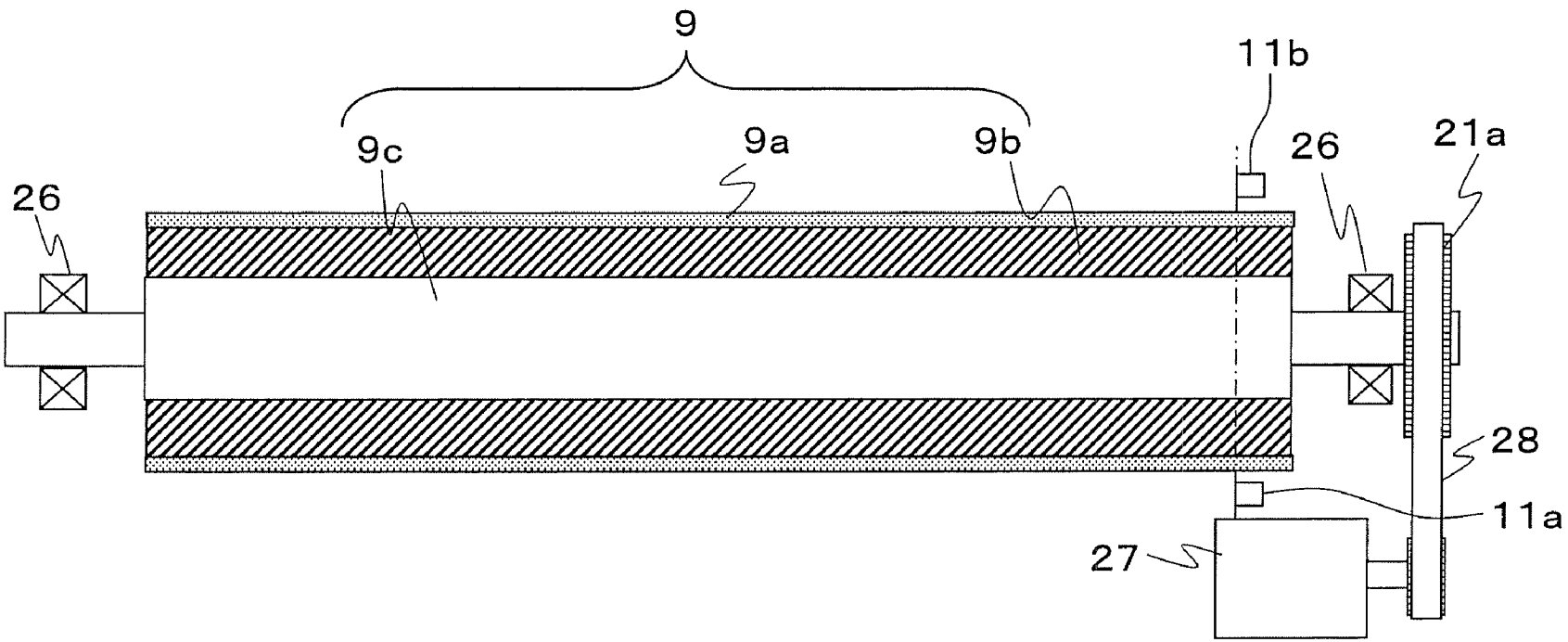
FIG. 3 is a drawing showing an exemplary configuration of a transfer roller according to an embodiment of the present invention.

As shown in FIG. 3, the transfer roller 9 includes a shaft 9*c* having stiffness characteristics, an elastic layer 9*b* surrounding the shaft 9*c*, and a dielectric layer 9*a* coating the elastic layer 9*b* as the outer surface of the transfer roller 9. The transfer roller 9 is rotatably and slidably supported so as to be in contact with or separated from the photosensitive body 1. Because of this structure, the transfer nip section between the transfer roller 9 and the photosensitive body 1 is formed when the transfer roller 9 is in contact with the photosensitive body 1 and disappeared when the transfer roller 9 is separated from the photosensitive body 1. It should be noted that instead of the transfer roller 9, a transfer belt serving the same role as that of the transfer roller supplying electric charges to a transfer body so as to transfer a toner image onto the transfer body may be used (Note: the transfer belt is not an intermediate transfer belt serving as an intermediate transfer medium). In this case, the voltage sensors 11*a* and 11*b* need to be provided on the upstream side and on the downstream side, respectively, in the rotating direction of the transfer roller 9 with respect to the transfer nip section.

Figure 2:
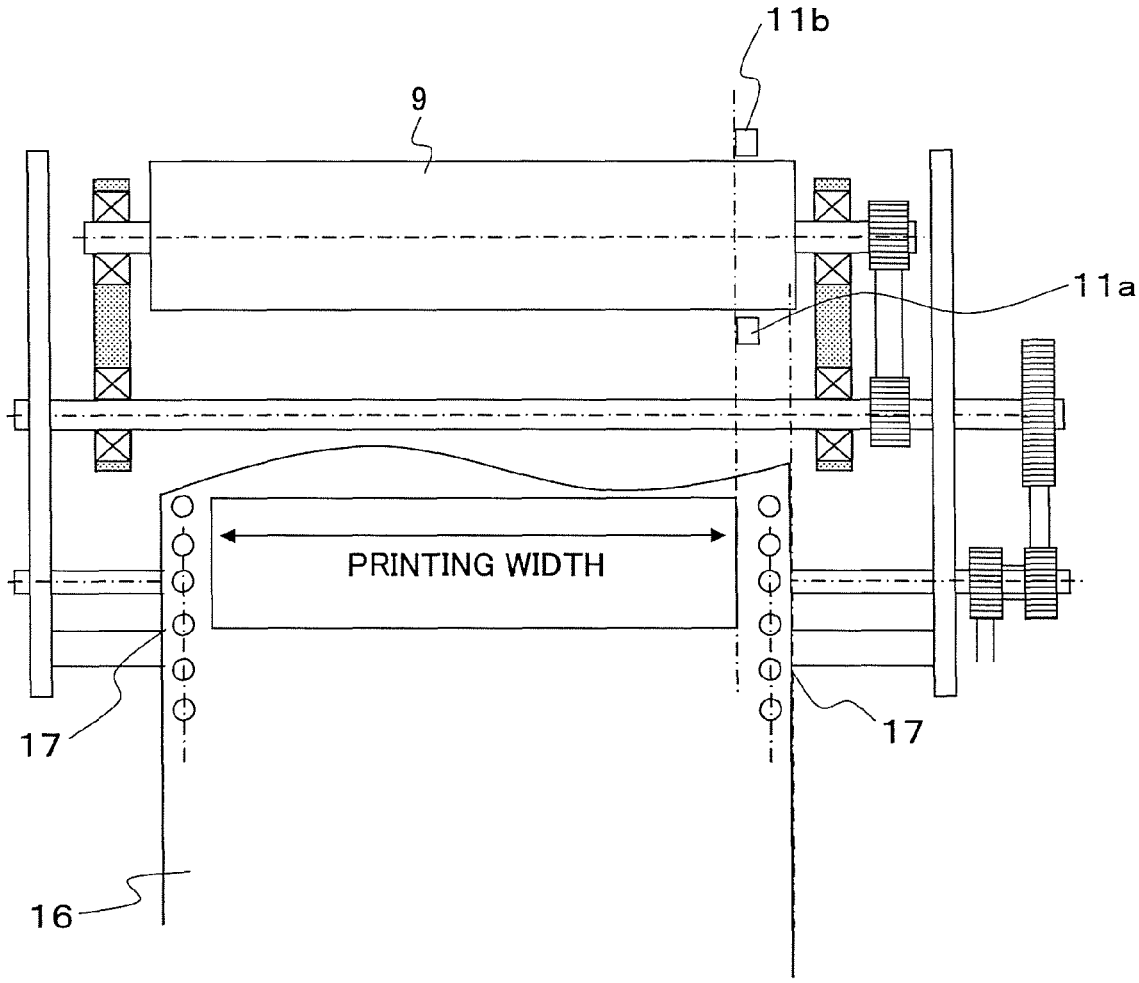
FIG. 2 is a schematic view showing positions of voltage sensors measuring voltages on a transfer roller according to an embodiment of the present invention.

As shown in FIG. 2, the continuous printing paper 16 has transfer holes along both lateral sides. The transfer holes of the continuous printing paper 16 are engaged by tractor pins of the tractors 17 provided on both upstream side and down stream side with respect to the transfer nip section of the transfer apparatus 6 so as to feed the continuous printing paper 16 (In FIG. 2, only tractors 17*a* on the upstream side are shown as the tractors 17). Each of the tractors 17*a* and 17*b* is driven by the driving force of a driving motor 27. In this embodiment, the driving force from the driving motor 27 is transmitted through a gear mechanism to the transfer roller 9. As a result, the rotation of the driving motor 27 causes the rotation of the transfer roller 9 and the rotation of the tractors 17 is synchronized with that of the transfer roller 9. In this embodiment, the transfer roller 9 and the tractors 17 are rotated in synchronization with each other. However, the embodiment of the present invention is not limited to this arrangement. For example, another driving source may be added and used, or the transfer roller may be driven by the moving force of the continuous printing paper 16. Similarly, each of the tractors 17*a* and the tractors 17*b* may be driven by separate driving motors.

In a printing operation, the transfer roller 9 is pressed against the photosensitive body 1 by an appropriate pressing force of a spring (not shown) so that a nip width (a vertical width of the transfer nip section) can be formed. The transfer apparatus 6 including the housing 7 is arranged to be moved by, for example, a cam mechanism so that the transfer roller 9 in the transfer apparatus 6 can be in contact with or separated from the photosensitive body 1. When the housing 7 is separated from the photosensitive body 1, each of the transfer roller 9, the upper paper guide 8*a* and the lower paper guide 8*b* is separated from the photosensitive body 1. As a result, the continuous printing paper 16 is separated from the photosensitive body 1 and a toner image on the photosensitive body 1 is no longer transferred onto the continuous printing paper 16.

Next, an exemplary configuration of the transfer roller 9 according to the embodiment of the present invention is described with reference to a schematic cut-open view in FIG. 3. As shown in FIG. 3, the shaft 9*c* of the transfer roller 9 is supported by bearings 26 at both ends of the shaft 9*c*. A pulley 21*a* is provided at a distal end of the shaft 9*c*, connected to the driving motor 27 through a timing belt 28. The shaft 9*c* of the transfer roller 9 is electrically grounded. A gear mechanism may be additionally provided when the driving motor 27 needs to drive the tractors 17 as well. As described above, a conductive elastic layer 9*b* is provided around the shaft 9*c* of the transfer roller 9, and the dielectric layer 9*a* coating on the elastic layer 9*b* as the outer surface of the transfer roller 9 is provided, thereby forming a two-layer structure. However, the present invention is not limited to this two-layer structure. For example, a three-layer structure may be employed. In the three-layer structure, preferably a dielectric layer such as a PFA is used as the surface layer; a conductive elastic layer or an electrically conductive layer such as an aluminum evaporated layer is used as the middle layer; and an electrically insulating elastic layer is used as the bottom layer. Further preferably, the conductive elastic layer should be a thin layer having a thickness of 3 mm or less because the conductive elastic layer is likely to be hardened. To make up for this thin layer, the thickness of the electrically insulating elastic layer may be increased to quantitatively control the entire thickness of the layers.

As a material of the elastic layer 9*b*, preferably a conductive material is mixed with a general elastic material such as epichlorohydrin rubber, urethane rubber, silicon rubber, fluoro rubber, ethylene-propylene rubber, or chloroprene rubber so that the volume resistivity of the elastic layer 9*b* is $10^8$ Ωcm or less so as to serve as a ground electrode with respect to the dielectric layer 9*a*. More preferably, the elastic layer 9*b* having the volume resistivity of less than $10^6$ Ωcm is used.

As a material of the dielectric layer 9*a*, a dielectric film including a polyester film such as PET or PEN, or a fluororesin film such as PTFE, FEP, PFA, ETFE, or PVDF is preferably used. More preferably, a TEFLON (registered trademark) film as a fluororesin film having excellent ozone resistance and high releasability is used.

Figure 4B:
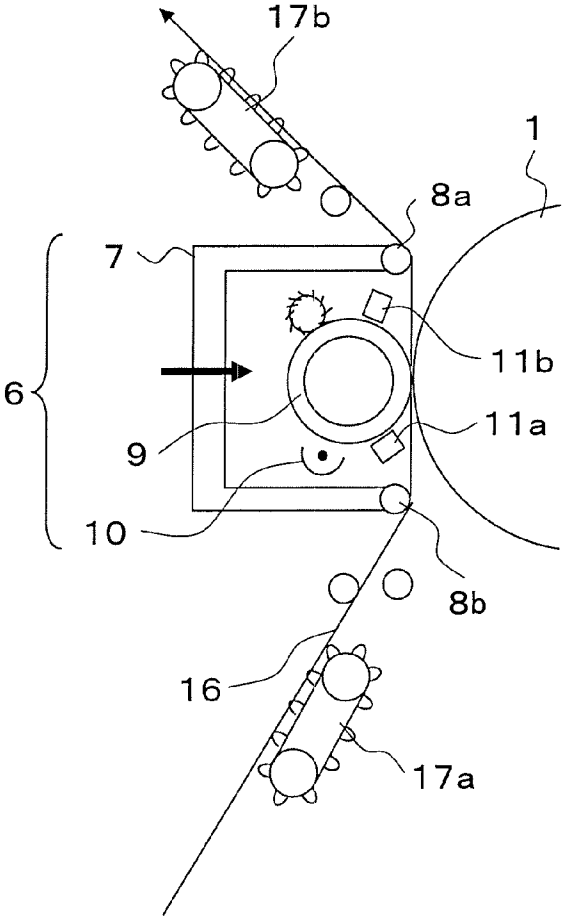
FIGS. 4A and 4B show statuses of the transfer apparatus and its peripheral parts in a print stand-by state and a printing state, respectively.
Figure 4A:
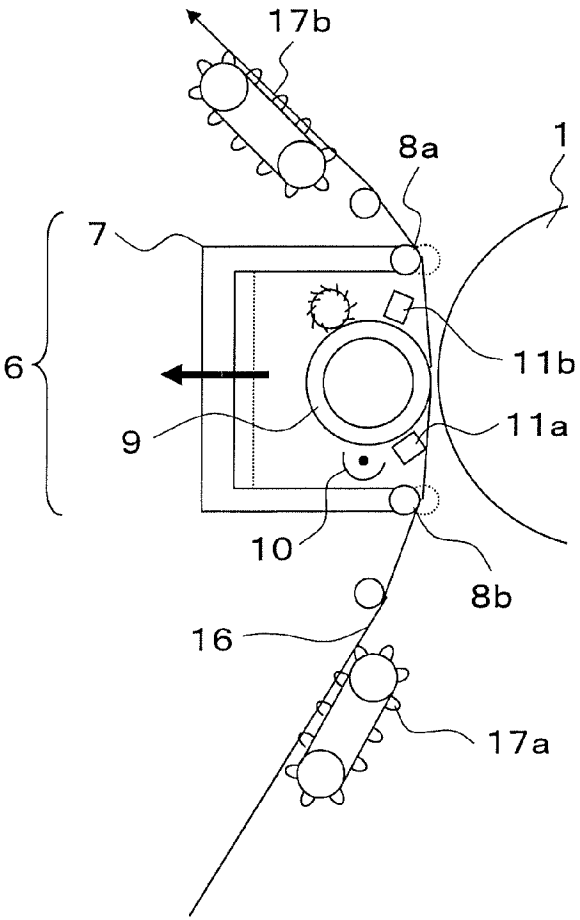

FIGS. 4A and 4B show statuses of the transfer apparatus 6 and its peripheral parts in a print stand-by state and a printing state, respectively. In the print stand-by state as shown in FIG. 4A, the transfer apparatus 6 is separated from the photosensitive body 1, and accordingly, the photosensitive body 1 is not in contact with the continuous printing paper 16, let alone the transfer roller 9. On the other hand, in the printing state as shown in FIG. 4B, the continuous printing paper 16 is started to be fed by the tractors 17. Just after feeding the continuous printing paper 16 is started to be fed, the housing 7 and the transfer roller 7 are started to move toward the photosensitive body 1. When a page head position of the continuous printing paper 16 reaches a transferring position, the continuous printing paper 16 is in contact with the photosensitive body 1 due to a pressing force of the transfer roller 9 so as to form an appropriate nip width. The transfer roller 9 presses the continuous printing paper 16 due to an appropriate pressing load by a spring. In this manner, preferably, the transfer roller is moved while a non-printing area between of the pages is at the transferring position.

When a toner image on the transfer roller 9 reaches the transfer nip section, the surface of the transfer roller 9 need to have been electrically charged up to a prescribed voltage. To that end, the charging device 2 starts charging the photosensitive body 1 while the photosensitive body 1 rotates and the photosensitive body 1 is still separated from the transfer roller 9. By doing this, the surface of the photosensitive body 1 charged up to the prescribed voltage can be in contact with the continuous printing paper 16 at the transfer nip section and a transferring operation can be started. On the other hand, when a printing operation ends, operations opposite to those described above are performed. Namely, the continuous printing paper 16 and the transfer roller 9 are separated from the photosensitive body 1 (non-contact status) and undergo preparations for the next printing operations.

As described above, in a transferring process in the "external charging method", electric charges are externally supplied to the dielectric layer 9*a* formed on the surface of the transfer roller 9; and the electric charges are supplied to the continuous printing paper 16 to transfer an image when the surface of the dielectric layer 9*a* having electric charges is in contact with a rear surface of the continuous printing paper 16 at the transfer nip section. However, in this "external charging method", all the electric charges within the dielectric layer 9*a* are not always supplied to a recording medium, and the amount of electric charges supplied to the continuous printing paper 16 varies depending on the type, thickness, and electrical resistance of the continuous printing paper 16 and environmental conditions such as temperature and humidity. Accordingly, the residual amount of electric charges within the dielectric layer 9*a* having passed the transfer nip section also varies depending on the type of the continuous printing paper 16 and the environmental conditions.

Figure 7:
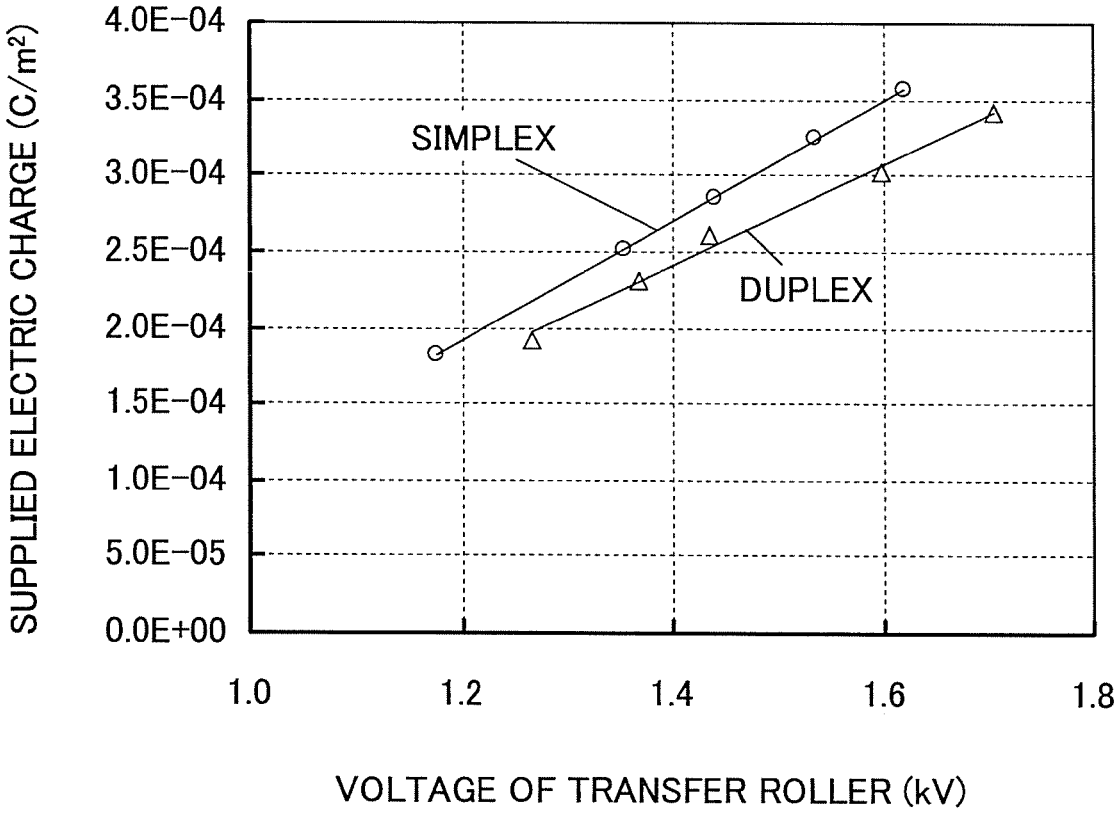
FIG. 7 is a graph showing relationships between a charged voltage of a surface of the transfer roller and amount of electric charges supplied to a recording medium.

FIG. 7 is a graph showing relationships between the voltage of a surface of the transfer roller 9 before the surface of the transfer roller 9 enters the transfer nip section and amount of electric charges supplied from the surface of the transfer roller 9 to a paper in the transfer nip section in the "external charging method". The upper line in the graph shows data when one-sided (front side) printing (simplex) is performed using 55 kg paper and the transfer roller 9 has a 30 μm PFA film as the dielectric layer 9*a*. The lower line in the graph shows data when the back side of the 55 kg paper is printed (duplex) after the front side of the paper is printed. On the other hand, the amount of electric charges supplied from the surface of the transfer roller 9 to the paper before, during, and after the surface of the transfer roller 9 passes the transfer nip section can be obtained from the difference between surface voltages of transfer roller 9 before and after the surface of the transfer roller 9 passes the transfer nip section. Namely, the amount of electric charges supplied to the paper corresponds to a reduction of the surface voltage obtained from the difference in surface voltages of transfer roller 9 before and after the surface of the transfer roller 9 passes the transfer nip section.

Once a paper is passed through the fixing device, the moisture content of the paper is lowered and the electric resistance of the paper is increased. When an image is transferred onto the paper (in duplex printing) and the transfer roller is charged to the same voltage as that in simplex printing, the amount of electric charge supplied to the paper is decreased because the charge transfer efficiency of the paper is lowered due to the higher electric resistance of the paper. As a result, unfortunately, a toner image may not be sufficiently transferred onto the paper. Also, higher residual voltage may be observed on the surface of the transfer roller 9.

In a transfer apparatus employing the "core bar applying method", a current flowing from a power source electrically connected to the core bar of the transfer roller 9 corresponds to the amount of electric charge supplied to the transfer nip section of the transfer roller 9 in a unit of time. Because of this feature, the amount of electric charge supplied to the transfer nip section of the transfer roller 9 can be easily detected and controlled. However, in the transfer apparatus 6 employing the "external charging method" as described above, the amount of dielectric charges supplied to the surface of the transfer roller 9 can be obtained from knowing the discharge current from the charger 10 to the transfer roller 9. However, unfortunately, as described above, the amount of dielectric charges supplied from the surface of the transfer roller 9 to the continuous printing paper 16 in the transfer nip section cannot be directly obtained from the current flowing through the charger 10. Because of this feature, it is difficult to directly and accurately measure the amount of electric charges supplied to each type of the continuous printing paper 16 and to appropriately control the amount of electric charges supplied to the transfer roller 9.

To solve the problems, according to an embodiment of the present invention, there are provided non-contact voltage sensors 11*a* and 11*b* for measuring the voltages of the surface of the transfer roller 9 on the upstream side and on the downstream side, respectively, with respect to the rotating direction of the transfer roller 9 and with respect to the transfer nip section where the transfer roller 9 is in contact with the photosensitive body 1 with the continuous printing paper 16 sandwiched between the transfer roller 9 and the photosensitive body 1. By using the voltage sensors 11*a* and 11*b*, the voltage of the surface of the transfer roller 9 before the surface enters the transfer nip section and the voltage of the surface of the transfer roller 9 after some of the electric charges are supplied to the continuous printing paper 16 and the surface has passed through the transfer nip section, respectively, are measured. Based on the values measured before and after the surface of the transfer roller 9 passes through the transfer nip section of the transfer roller 9, the discharge current from the charger 10 to the transfer roller 9 is adjusted, thereby adjusting the amount of electric charges supplied to the transfer roller 9.

When the amount of electric charges supplied to the continuous printing paper 16 in the transfer nip section is denoted as "σ", "σ" is given by the following formula (1):

$$\sigma=(V_0-V_1)\times\in_0\times\in/t \quad (1)$$

where

"$V_0$": voltage (V) measured on the surface of the transfer roller 9 before the surface enters the transfer nip section of the transfer roller 9, "$V_1$": voltage (V) measured on the surface of the transfer roller 9 after the surface has passed through the transfer nip section of the transfer roller 9, "$\in_0$": permittivity of vacuum ($=8.85\times10^{-12}$) (F/m), "$\in$": relative permittivity of the dielectric layer 9*a*, and "t": thickness (m) of the dielectric layer 9*a*.

Therefore, the amount of electric charges supplied to the continuous printing paper 16 in the transfer nip section "σ" is determined when the relative permittivity "$\in$" and the thickness "t" of the dielectric layer 9*a* of the transfer roller 9 are determined and the voltages "$V_0$" and "$V_1$" on the surface of the transfer roller 9 before and after, respectively, the surface passes the transfer nip section are measured.

Figure 8:
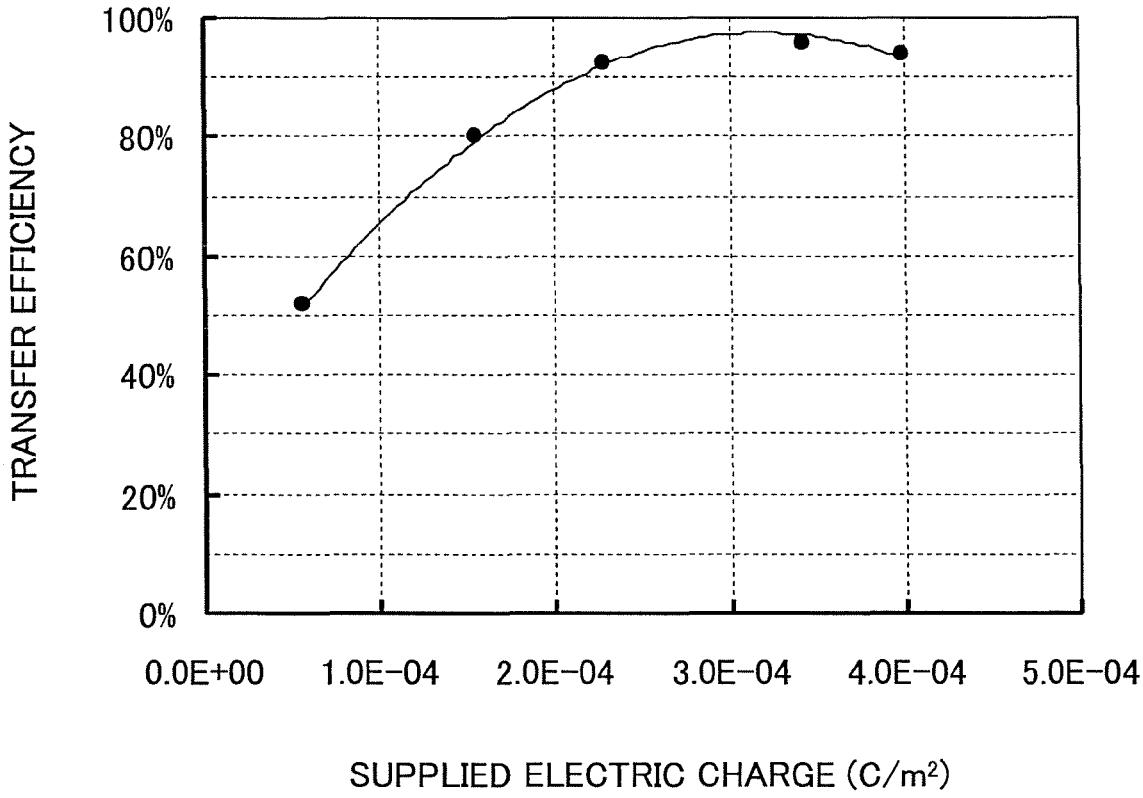
FIG. 8 is a graph showing relationships between the amount of electric charges supplied to a recording medium and transfer efficiency.

FIG. 8 is a graph showing relationships between the amount of electric charges supplied to the continuous printing paper 16 and transfer efficiency of toner from a toner carrier to the recording medium (continuous printing paper 16). The amount of electric charges is obtained by using the above formula (1) from the voltages "$V_0$" and "$V_1$" measured by the voltage sensors 11*a* and 11*b* while discharged current from the corotron charger 10 is sequentially changed. As shown in graph of FIG. 8, the transfer efficiency can be 90% or more by adjusting the amount of electric charges to be supplied in a range between $2.2\times10^{-4}$ and $4.0\times10^{-4}$ C/m$^2$.

As described above, the transfer efficiency can be adjusted by adjusting the amount of electric charges supplied from the charger 10 to the transfer roller 9 based on the measurement results of the voltage sensors 11*a* and 11*b* on the upstream side and on the downstream side, respectively, with respect to the transfer nip section. Therefore, it becomes possible to respond to various types and conditions of the continuous printing paper 16 and environmental conditions, to supply appropriate electric charges, and to stably perform an appropriate transfer process for a long period by ascertaining appropriate amounts of electric charges in advance so as to respond to the various types and conditions of the continuous printing paper 16 and environmental conditions and adjusting discharging conditions of the charger 10 so that a voltage difference ($V_0-V_1$) is within an appropriate range. By doing this, an appropriate image forming process can be consistently performed. Especially, it is possible to respond to the changes of environmental conditions and the status of papers by continuously measuring the voltage difference ($V_0-V_1$) of the surface of the transfer roller 9.

The voltage "$V_1$" measured on the surface of the transfer roller 9 after the surface has passed through the transfer nip section of the transfer roller 9 varies depending on the amount of toner (particles) deposited on the toner carrier. The more toner particles deposited on the toner carrier, the more are electric charges supplied to the continuous printing paper 16 and the more the voltage "$V_1$" is lowered. Because of this feature, preferably, the voltages "$V_0$" and "$V_1$" of the surface of the transfer roller 9 are measured only when the same printing pattern passes though the transfer nip section. To be able to realize this, for example, the voltages are measured when a non-printing area between the pages of the paper passes though the transfer nip section by calculating the timing when the area between the pages of the paper reaches the transfer nip section from a page start signal. As another example, the voltages are measured when a blank area passes though the transfer nip section by calculating the timing when the blank area reaches the transfer nip section from printing data. By doing this, stable voltage measurement can be performed. Usually, it is preferable to measure the voltages when the transfer roller 9 is in contact with the paper and an area where no toner image is transferred to the paper (so-called blank area) is passing through the transfer nip section.

Second Embodiment

Next, an image forming apparatus having a transfer apparatus according to a second embodiment of the present invention is described. In the second embodiment of the present invention, each of the voltage sensors 11*a* and 11*b* faces the surface of the transfer roller 9 where the surface of transfer roller 9 is in contact with a non-printing area of a printing paper where no toner image is transferred onto the printing paper when the transfer roller 9 rotates. Usually, such a non-printing area is provided at each side in the width direction of the printing paper. Advantageously, as described above, by the voltage sensors 11*a* and 11*b* facing the surface of the transfer roller 9 where the surface of transfer roller 9 is in contact with a printing paper in a non-printing area of the printing paper as the transfer roller 9 rotates, it becomes possible to measure the amount of electric charges that may vary depending on the type of printing paper without being affected by a measurement error of the amount of electric charges due to the existence of a toner image. Except for the positions of the voltage sensors 11*a* and 11*b*, the configuration and the operations of the transfer apparatus 6 according to this embodiment of the present invention are the same as those of the transfer apparatus 6 according to the first embodiment of the present invention.

FIG. 2 shows positional relationships among the transfer roller 9, the continuous printing paper 16, the tractors 17, and the voltage sensors 11*a* and 11*b* according to the second embodiment of the present invention. As shown in FIG. 2, the position of the continuous printing paper 16 in the width (horizontal) direction is fixed by the positions of tractor pins of the tractor 17 on the right-hand side of FIG. 2. In this configuration, when a paper having a different width is used, only the position of tractor pins on the left-hand side of FIG. 2 is shifted and adjusted. In FIG. 2, a printable continuous printing paper 16 having the maximum width is illustrated. When a continuous printing paper 16 to be used has a different width, only the positions of the left-hand-side tractor pins are changed, and the positions of the right-hand side tractor pins are unchanged. Therefore, the area where an end part on the right-hand side of the continuous printing paper 16 is in contact with the transfer roller 9 is unchanged. Because of this feature, the positions of the voltage sensors 11*a* and 11*b* are determined. Specifically, as shown in FIG. 2, the voltage sensors 11*a* and 11*b* are opposite to each other with respect to the transfer nip section, inside the right end of the continuous printing paper 16, and outside of the right end of the printing width of the continuous printing paper 16 so as to measure the voltages on opposite side of the transfer nip section on the surface of the transfer roller 9 at any time.

By disposing the voltage sensors 11*a* and 11*b* at the positions as described above, a blank area of any continuous printing paper 16 used always passes through the transfer nip section in printing. Because of this feature, it becomes possible to measure the voltages of the surface of the transfer roller 9 corresponding to the blank area. Further, by adjusting an applied voltage or current to the charger 10 charging the transfer roller 9 in a printing operation so that the voltage difference ($V_0$–$V_1$) between the upstream side and the downstream side of the transfer nip section of the transfer roller 9 is maintained substantially constant, it becomes possible to reduce the fluctuation of image quality during the operation of a continuous-paper printer which may print for a long period using rolled paper and to obtain stable image quality without degrading the image quality for a long period.

Third Embodiment

Figure 5:
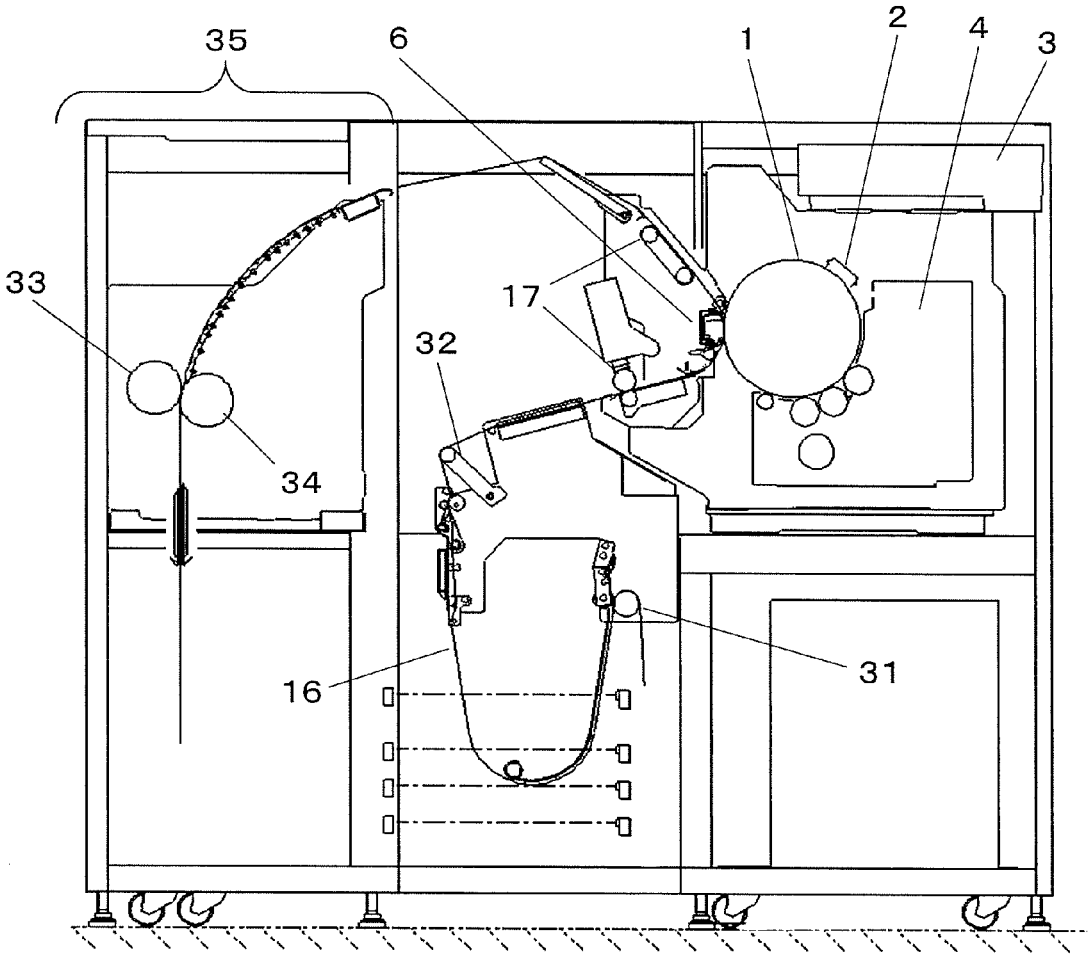
FIG. 5 is a drawing schematically showing an exemplary configuration of a continuous-paper printer employing a transfer apparatus according to an embodiment of the present invention.
Figure 6:
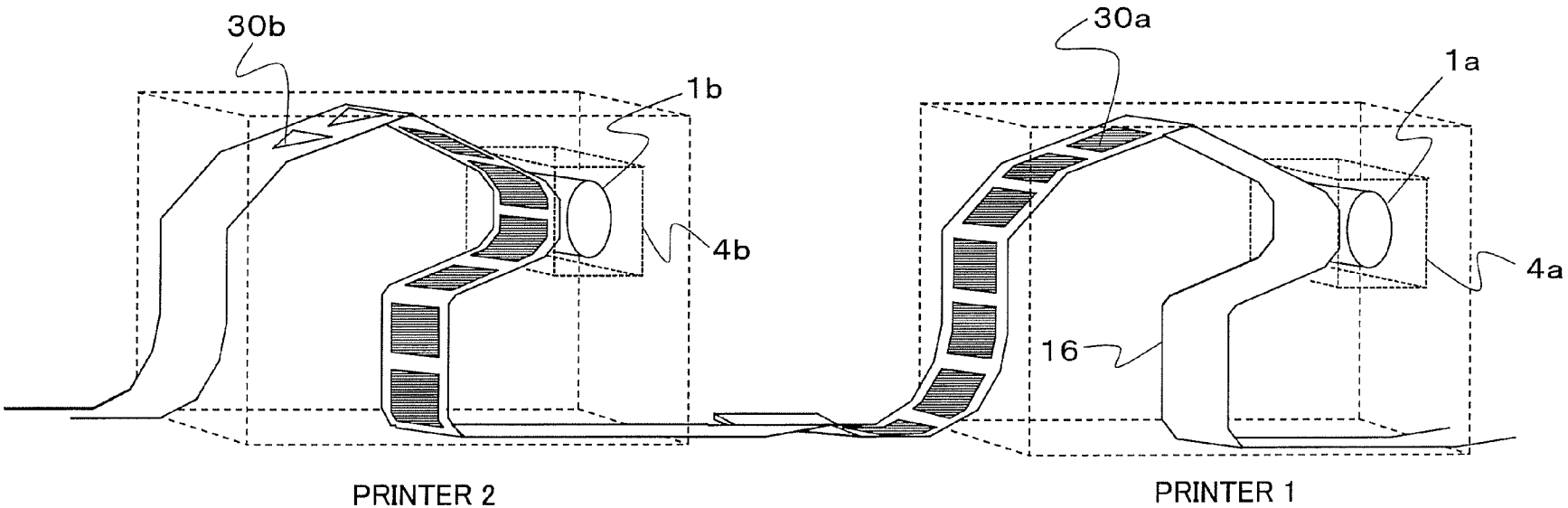
FIG. 6 is a drawing schematically showing a both-sides (duplex) printer using two image forming apparatuses according to the embodiment of the present invention.

FIG. 5 shows a continuous-paper printer employing a transfer apparatus according to an embodiment of the present invention. In this embodiment as shown in FIG. 5, a charging device 2, an exposing device 3, a developing device 4, and the transfer apparatus 6 are provided as a developing unit in the rotating direction of the photosensitive body 1 having a diameter of approximately 262 mm. On the other hand, a continuous printing paper 16 is fed to the transfer nip section by the tractors 17 and printing paper feed devices 31 and 32 and the toner image on the photosensitive body 1 is transferred onto the continuous printing paper 16. The toner image transferred onto the continuous printing paper 16 is heated to the transfer temperature of toner resin while passing through a preheater. The toner image is melted and fixed onto the continuous printing paper 16 by a fixing device 35 including a heat roller 33 having a built-in heater and a backup roller 34. Further, as shown in FIG. 6, both-sides (duplex) printing can be realized by using two image forming apparatuses according to the embodiment of the present invention.

Still further, the transfer apparatus according to an embodiment of the present invention provides stable high image quality and ultra-high speed printing having processing speed approximately 1700 mm/s for a long period.

Fourth Embodiment

Recently, full-color image forming apparatuses have become popular. Such a full-color image forming apparatus generally includes four developing units for forming a color toner image composed of four colors, black, cyan, magenta, and yellow, and an intermediate transfer belt. Further, many of such full-color image forming apparatuses can print an image onto continuous paper. An intermediate transfer belt is a kind of transfer body like a continuous printing paper 16 because toner images are transferred onto the intermediate transfer belt. The developing devices corresponding to the colors are sequentially arranged so as to face the intermediate transfer belt serving as an intermediate image carrier. Toner images of each color toner are sequentially transferred onto the intermediate transfer belt. In this case, each transfer apparatus for transferring a toner image onto the intermediate transfer belt faces the corresponding developing unit. In each transfer apparatus, as described in the first and the second embodiments of the present invention, a pair of voltage sensors is provided, and the amount of electric charges supplied to the transfer roller 9 is adjusted by measuring the voltages on the upstream and the downstream sides of the transfer roller 9 with respect to the transfer nip section of the transfer roller 9 so as to maintain the voltage difference between the measured voltages substantially at a prescribed value. A full-color toner image on the intermediate transfer belt transferred by the four developing units corresponding to the four colors is further transferred onto the continuous printing paper 16 by a transfer apparatus. This transfer apparatus also includes a pair of voltage sensors, and the amount of electric charges supplied to the transfer roller 9 is adjusted by measuring the voltages on the upstream and the downstream sides of the transfer roller 9 with respect to the transfer nip section of the transfer roller 9 so as to maintain the voltage difference between the measured voltages substantially at a prescribed value. Then, the continuous printing paper 16 is heated and pressed by the fixing device so that the toner image on the continuous printing paper 16 is melted and fixed onto the continuous printing paper 16 to form the full-color image on the continuous printing paper 16. The continuous printing paper 16 is folded and stored into a paper folding section. Usually, in the fixing device, the heat roller 33 applies a driving force to feed the paper and presses the continuous printing paper 16 along with the backup roller 34 to press and heat the continuous printing paper 16 and feed the continuous printing paper 16 to, for example, a paper tray. In full-color printing, the color of the entire image varies depending on the amount of each color toner. Therefore, controlling the transfer efficiency of an image in the transfer process becomes of particular importance. Advantageously, the transfer apparatus according to an embodiment of the present invention can be preferably used in such a full-color image forming apparatus.

Although the invention has been described with reference to a specific embodiment for a complete and clear disclosure, the appended claims are not to be thus limited but are to be construed as embodying all modifications and alternative constructions that may occur to one skilled in the art that fairly fall within the basic teachings herein set force.

The present application is based on and claims the benefit of priority of Japanese Patent Application No. 2007-177513, filed on Jul. 5, 2007, the entire contents of which are hereby incorporated herein by reference.

What is claimed is:

1. A transfer apparatus for transferring a toner image from a toner image carrier to a transfer body in an image forming apparatus employing an electrophotographic method, the transfer apparatus comprising:

a transfer member electrically charging the transfer body;

a charging unit for electrically charging a surface of the transfer member; and voltage sensors provided at each of an upstream area and a downstream area of a transfer nip section of the transfer member to measure a voltage at each of the upstream and the downstream area on the transfer member with respect to the transfer nip section of the transfer member, wherein a voltage measurement position at which each of the voltage sensors measures the voltage is on a part of the surface of the transfer member, and the part of the surface of the transfer member is in contact with a toner image non-transfer area onto which no toner image is transferred when a toner image is transferred onto the transfer body.

2. The transfer apparatus according to claim 1, wherein the charging unit includes:

a charge controlling unit controlling amount of electric charges from the charging unit to the transfer member so that a voltage difference between the upstream area and the downstream area with respect to the transfer nip section of the transfer member is maintained substantially at a prescribed value.

3. The transfer apparatus according to claim 1, wherein each of the voltage sensors is a noncontact voltage sensor.

4. The transfer apparatus according to claim 1, wherein the transfer body is one of a recording medium and an intermediate transfer medium.

5. The transfer apparatus according to claim 1, wherein the transfer member is one of a transfer roller and a transfer belt.

6. A transfer method of transferring a toner image from a toner image carrier onto a transfer body by a transfer apparatus having a transfer member in an image forming apparatus employing an electrophotographic method, the transfer method comprising:

detecting a voltage difference between an upstream area and a downstream area with respect to a transfer nip section of the transfer member;

maintaining the detected voltage difference; and supplying electric charges to a surface of the transfer member so that the voltage difference between the upstream area and the downstream area with respect to the transfer nip section of the transfer member is maintained substantially at a prescribed value, wherein the voltage difference between the upstream area and the downstream area with respect to the transfer nip section of the transfer member is a voltage difference between parts of the surface of the transfer member, and each of the parts of the surface of the transfer member is in contact with a toner image non-transfer area onto which no toner image is transferred when a toner image is transferred onto the transfer body.

7. An image forming apparatus employing an electrophotographic method and including a photosensitive body, a charging device electrically charging the photosensitive body, an exposing device forming an electrostatic latent image on the charged photosensitive body, a developing device developing the electrostatic latent image into a toner image, a transfer apparatus transferring the toner image onto a recording medium, a feeding device feeding the recording medium, and a fixing device fixing the toner image onto the recording medium onto which the toner image is transferred, wherein the transfer apparatus is the transfer apparatus according to claim 1.

* * * * *